US009472074B2

(12) United States Patent
Hazelwood et al.

(10) Patent No.: US 9,472,074 B2
(45) Date of Patent: Oct. 18, 2016

(54) SECURITY TAG ALERTING FOR CONTINUOUS MOVEMENT

(71) Applicant: Checkpoint Systems, Inc., Thorofare, NJ (US)

(72) Inventors: Zachary Cody Hazelwood, Nashville, TN (US); Richard Hoehn, Nashville, TN (US); Merril F. Bradshaw, Waxhaw, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 8 days.

(21) Appl. No.: 14/575,941

(22) Filed: Dec. 18, 2014

(65) Prior Publication Data

US 2016/0180671 A1 Jun. 23, 2016

(51) Int. Cl.
*G08B 13/14* (2006.01)
*G08B 13/24* (2006.01)

(52) U.S. Cl.
CPC ..... *G08B 13/2462* (2013.01)

(58) Field of Classification Search
CPC ..... G04B 13/2402; G04B 13/2462
USPC ..... 340/568.1, 568.8, 571, 571.1, 572, 340/573.4, 572.4
See application file for complete search history.

(56) References Cited

U.S. PATENT DOCUMENTS

2008/0030359 A1* 2/2008 Smith ..... G01S 13/767 340/686.1
2008/0246613 A1* 10/2008 Linstrom ..... G08B 13/19695 340/572.4
2011/0080267 A1* 4/2011 Clare ..... G01S 13/82 340/10.4
2011/0084840 A1 4/2011 Mercier et al.
2012/0307051 A1* 12/2012 Welter ..... G08B 13/2482 348/143
2014/0210660 A1* 7/2014 Larose ..... G01S 13/06 342/146
2014/0351098 A1 11/2014 Shafer et al.

FOREIGN PATENT DOCUMENTS

GB 2410347 A 7/2005

OTHER PUBLICATIONS

Extended Search Report and Written Opinion of corresponding European application No. 15198509.0 mailed Mar. 3, 2016, all enclosed pages cited.

* cited by examiner

*Primary Examiner* — Kevin Kim
(74) *Attorney, Agent, or Firm* — Nelson Mullins Riley & Scarborough, LLP

(57) ABSTRACT

A tag controller may be configured to interface with one or more security tags and at least one of the tags may be adapted to be disposed on a product in a monitoring environment. The tag controller may include processing circuitry configured to receive location information indicative of tag location responsive to initial movement of a tag, and compare the location information to alerting criteria. The alerting criteria may include at least a position component and a temporal component. The processing circuitry may be further configured to initiate an alerting function responsive to the alerting criteria being met.

18 Claims, 6 Drawing Sheets

SECURITY TAG ALERTING FOR CONTINUOUS MOVEMENT

TECHNICAL FIELD

Various example embodiments relate generally to retail theft deterrent and merchandise protection devices and methods.

BACKGROUND

Security devices have continued to evolve over time to improve the functional capabilities and reduce the cost of such devices. Some security devices are currently provided to be attached to individual products or objects in order to deter or prevent theft of such products or objects. In some cases, the security devices include tags or other such components that can be detected by gate devices at the exit of a retail establishment. These gate devices may be sometimes referred to as towers or pedestals. When the security device passes through or proximate to the gates, an alarm or other notification locally at the product and/or at the gates may be triggered. Additionally, a key may be provided at the point of sale terminal so that the security device can be removed when the corresponding products or objects are purchased.

In order to improve the ability of retailers to deter theft, the security devices and systems in which they operate are continuously being improved. For example, various improvements may be introduced to attempt to improve location accuracy or to carry out certain specific desired functions related to tracking tags and issuing notifications based on the tracking of the tags. However, it may be difficult to determine the appropriate balance of characteristics for a given system.

BRIEF SUMMARY OF SOME EXAMPLES

Some example embodiments may provide tags that are configurable to enable operators to be alerted when certain behaviors are detected based on movement of the tags.

In one example embodiment, a tag controller may be configured to interface with one or more security tags and at least one of the tags may be adapted to be disposed on a product in a monitoring environment. The tag controller may include processing circuitry configured to receive location information indicative of tag location responsive to initial movement of a tag, and compare the location information to alerting criteria. The alerting criteria may include at least a position component and a temporal component. The processing circuitry may be further configured to initiate an alerting function responsive to the alerting criteria being met.

According to another example embodiment, a security system is provided. The security system may include a plurality of security tags disposed on a corresponding plurality of products in a monitoring environment, a plurality of locator devices associated with a locating system for tracking the security tags in the monitoring environment, and a tag controller. The tag controller may include processing circuitry configured to receive location information indicative of tag location responsive to initial movement of a tag, and compare the location information to alerting criteria. The alerting criteria may include at least a position component and a temporal component. The processing circuitry may be further configured to initiate an alerting function responsive to the alerting criteria being met.

BRIEF DESCRIPTION OF THE SEVERAL VIEWS OF THE DRAWING(S)

Having thus described some example embodiments of the invention in general terms, reference will now be made to the accompanying drawings, which are not necessarily drawn to scale, and wherein:

DETAILED DESCRIPTION

Figure 1:
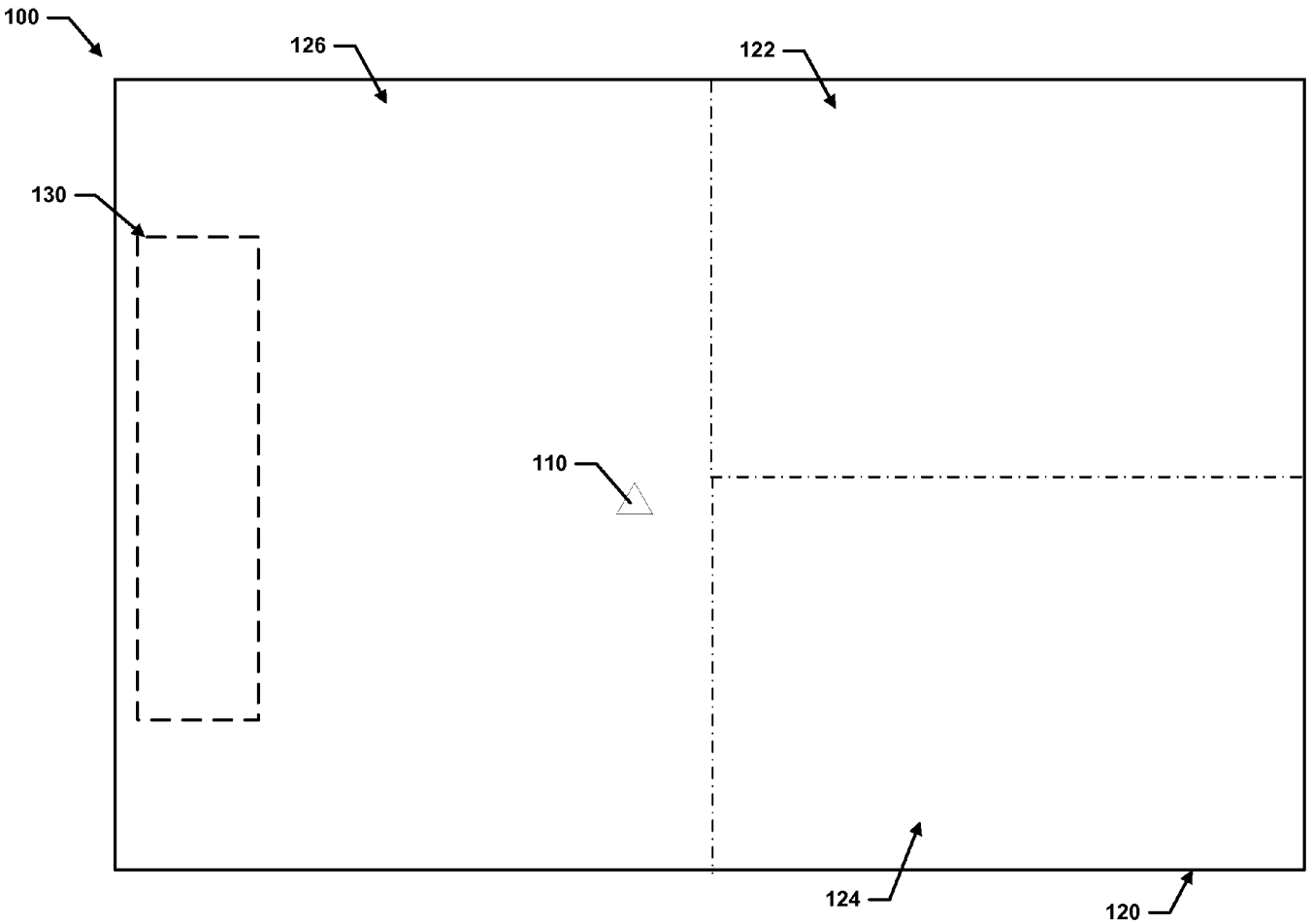
FIG. 1 illustrates a conceptual diagram of a monitoring environment within a retail store according to an example embodiment.

Some example embodiments now will be described more fully hereinafter with reference to the accompanying drawings, in which some, but not all embodiments are shown. Indeed, the examples described and pictured herein should not be construed as being limiting as to the scope, applicability or configuration of the present disclosure. Like reference numerals refer to like elements throughout. Furthermore, as used herein, the term "or" is to be interpreted as a logical operator that results in true whenever one or more of its operands are true. As used herein, "operable coupling" should be understood to relate to direct or indirect connection that, in either case, enables at least a functional interconnection of components that are operably coupled to each other.

Customers may be looking for product or personnel within a particular department of a retail store and have difficulty locating that for which they are searching. In such situations, the customers often have differing levels of patience and tolerance for facing such difficulties. For example, some customers may immediately and aggressively find a staff person to assist them, while other customers may wander around the department (or zone) in which they are seeking assistance. In some cases, although a customer may be receptive to assistance from a staff person, the customer may not be inclined to solicit assistance and may begin to wander a bit to see if they can find what they are looking for without assistance. Well trained staff may be able to spot customers that look as though they could use assistance, but have not yet reached the point of asking. When customers have not yet reached the point of asking, and a staff member proactively offers assistance, the perception of customer service in the store may be enhanced.

Good training and availability of staff throughout the store can certainly facilitate the perception of good customer service, as described above. However, since the behavior of customers that are perhaps on the verge of seeking or needing assistance is observable, it may be helpful to improve the ability of the retail store to identify such individuals. In many situations, the customers may be holding or may have placed certain products or items in a shopping cart. If these products are tagged with theft deterrent devices or other such trackable devices, the movement of the products may be tracked. Although the movement of such devices may normally be used to ensure that the tags are not removed from the products without proper point of sale processing, it may be further possible to enhance customer service by analyzing customer behavior to identify customers that may seem to be wandering in the same area (perhaps looking for an elusive product or a staff person).

Some example embodiments may enable provision of a network capable of detecting when security devices (e.g., tags) are placed in motion and tracking such devices. Moreover, when the security devices are tracked and appear to be wandering within a particular area for a certain threshold amount of time, example embodiments may provide an alert to direct store personnel to the area of the wandering customer so that assistance may be offered. The proactive offer of assistance may result in an improved perception of customer service, and may also enhance sales since products and/or services may be rendered more efficiently while generating customer loyalty.

An example embodiment will be described herein as it relates to a security device (e.g., a tag) that can be attached to an object (e.g., a retail product) and wirelessly communicate with components of an anti-theft asset monitoring network. However, it should be appreciated that the network need not necessarily have the focus of deterring theft. The network components and the tags may be configured to communicate with each other via any of a number of different communication schemes. Some of these schemes may only monitor for tags in an area proximate to an exit of the retail store being protected. Other schemes may monitor tags throughout the retail store or in various specific zones that may be defined. Furthermore, some embodiments may employ more than one communication scheme simultaneously or in a manner that allows switching between such communication schemes. Since this represents an example of a relatively complex communication paradigm in which an example embodiment is likely to be practiced, an example monitoring environment will be described that employs more than one communication scheme.

Figure 2:
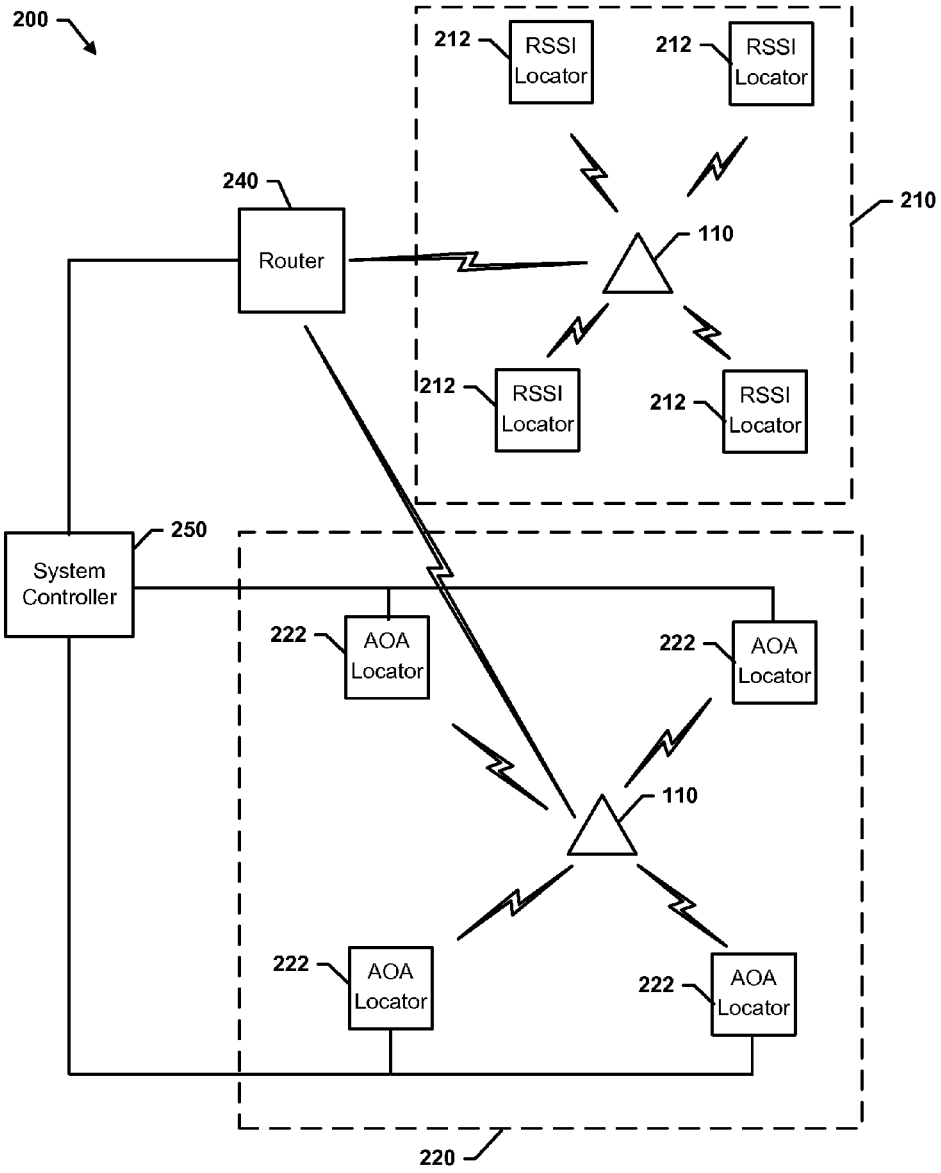
FIG. 2 illustrates a block diagram of a monitoring network that may be employed to monitor tags that may be placed on objects (products) in the monitoring environment in accordance with an example embodiment.

FIG. 1 illustrates a conceptual diagram of a monitoring environment 100 within a retail store. FIG. 2 illustrates a block diagram of a monitoring network 200 that may be employed to monitor tags 110 that may be placed on objects (products) in the monitoring environment 100 in accordance with an example embodiment. As shown in FIG. 1, the monitoring environment 100 may include a first monitoring zone 120 and a second monitoring zone 130. The first monitoring zone 120 may represent a relatively large area of the store (e.g., the sales floor). The second monitoring zone 130 may represent a smaller area of the store and, in some cases, may be proximate to the exit of the store. The first and second monitoring zones 120 and 130 may be exclusively defined or, in some embodiments, the second monitoring zone 130 may exist within and overlap with the first monitoring zone 120.

In some embodiments, the monitoring zones may be further divided into sub-zones. For example, as shown in FIG. 1, the first monitoring zone 120 may be divided into a first sub-zone 122, a second sub-zone 124 and a third sub-zone 126. In some cases, the sub-zones may be correlated with specific departments, locations or product lines within the store. However, the sub-zones could alternatively be defined to divide the monitoring environment 100 into conveniently defined regions to facilitate locating tags 110 within particular regions and detect movement within, out of, or into such regions. In some cases, the sub-zones may be defined at least in part based on proximity to the exit and/or to the second monitoring zone 130. Combinations of the above-described ways of defining sub-zones may also be employed.

In some cases, the second monitoring zone 130 may employ a more accurate and/or sensitive locating technique than the locating technique employed in the first monitoring zone 120. Although the first monitoring zone 120 may sometimes employ a less accurate or sensitive locating technique than the second monitoring zone 130, in some situations, the sub-zones of the first monitoring zone 120 may employ different levels of sensitivity (e.g., using higher or lower sample rates) in different sub-zones. For example, the third sub-zone 126, which is closer to the second monitoring zone 130 and the exit, may employ a higher sample rate for improved accuracy and sensitivity relative to the sample rate employed in the first and second sub-zones 122 and 124. Accordingly, as a product moves closer to the exit, the sensitivity to detection of the location of the product may increase.

The monitoring network 200 may include a first locating system 210 and a second locating system 220. Each of the first locating system 210 and the second locating system 220 may employ differing techniques for locating a tag 110 and may utilize a corresponding different hardware suite and communication paradigm. In an example embodiment, the first locating system 210 may be a locating system that employs received signal strength indication (RSSI) technology for locating the tags 110. Meanwhile, the second locating system 220 may employ angle of arrival (AOA) technology or other locating techniques, such as time of arrival (TOA), time differential of arrival (TDOA), or other techniques where a tag 110 sends a beacon signal to be listened for by an array of receivers to locate the tags 110. For example, AOA technology may employ receivers or AOA locators 222 including antenna arrays that listen for beacon packets, sent from the tags 110, having the correct format, and then process the packets to determine an angle of arrival of the packet relative to the receiver and the antenna array position. The active area of measurement may be relative to the center point of the antenna. Angle data may be calculated using peaks of angle curves generated based on beacon signals received in the active sensing area of the antennas of the array.

Further, for locating via AOA technology, the tags 110 may be configured to act as beacon devices sending out signals to be detected by AOA locators 222. The AOA locators 222, which may be configured as a patch antenna array (e.g., with 4 antennas) with each of the AOA locators 222 being disposed, for example, at or near corners of the second monitoring zone 130 (or the third sub-zone 126). Generally speaking, in the RSSI system (e.g., the first locating system 210), the tags 110 may be configured to act as listening devices to receive beacon signals transmitted from RSSI locators 212. Based on the signal strengths of the signals received from each of the RSSI locators 212, the position of the tag 110 relative to the RSSI locators 212 may be determined.

While the first locating system 210 and the second locating system 200 are described as employing different techniques for determining the location of a tag 110 (i.e., RSSI, AOA, TOA, TDOA, etc.), it is understood that, according to some example embodiments, the same technique could be used in both systems, however with different parameters between the systems. For example, the first locating system 210 may employ TDOA a lower sample rate than the second locating system 220 also employing TDOA.

In some embodiments, the second locating system 220 may be used to implement a gate solution for monitoring the exit of the store. Thus, for example, the second locating system 220 may be employed in the second monitoring zone 130. However, the second locating system 220 could also or alternatively be employed for an accurate (or at least more accurate) inventory zone inside which more accurate monitoring of tag 110 movement may be accomplished. Thus, for example, the second locating system 220 may be employed in the third sub-zone 126 to increase sensitivity to tag 110 location as the tag 110 moves closer to the exit. Moreover, the second locating system 220 may have low sample rate and high sample rate operational capabilities such that, for example, low rate AOA locating may be performed in the third sub-zone 126 and high rate AOA locating may be performed in the second monitoring zone 130. Finally, the first and/or second locating system 210 and 220 may be used for general tag 110 location determination with varying levels of accuracy dependent upon the locating technology used and the sample rate employed.

In some embodiments, since both the first and second locating systems 210 and 220 may be employed proximate to each other or even in the same area, the tags 110 may be configured to communicate with either or both of the first and second locating systems 210 and 220. In some cases, the second (e.g., AOA) and the first (e.g., RSSI) systems may be supported by employing an interleaved sample window. As such, for example, the tags 110 may be configured to read or listen for beacon signals transmitted from RSSI locators 212 every 500 msec. Thus, the RSSI sample rate may be half a second. Meanwhile, the RSSI locators 212 may be configured to beacon at a higher rate. The tags 110 may also be configured to beacon themselves with a 500 msec low rate beacon time with 20 msec slot times that are able to be changed to 160 msec high rate beaconing time to support, for example, AOA locating. This can provide a relatively large number of time slots (e.g., 25) that can be divided between high rate and low rate sampling via AOA, while also being interleaved with RSSI sampling. The specific details of locating system communication frequencies, sampling rates, and location determination algorithms may change in various different embodiments. Thus, the description above should be appreciated as merely one example implementation that may be employed in some contexts.

In an example embodiment, the number of tags that can be tracked or monitored may depend on the number of samples needed for required or desired accuracy and a desired hit rate for a given operational scenario. Different tracking requirements may be prescribed for various zones, sub-zones and/or the like based on the needs or desires of the retailer. Thus, for example, an alarm zone, an approach zone and other inventory tracking zones may be defined and different sample rates and/or other system characteristics may be defined in each zone. Meanwhile, in each zone, the tags 110 may be trackable using either or both of the first locating system 210 and the second locating system 220.

In some example embodiments, regardless of the type of systems that are being employed, a tag 110 may be configured to operate in a low power mode where the tag is asleep and wakes up to check in with the network, for example via system controller 250, at relatively large intervals (e.g., every 30 minutes). Movement of the tag 110 (e.g., as detected local to the tag via an accelerometer or jiggle switch) may cause the tag 110 to wake up, leave the low power mode to enter an active mode, and initiate communication with the system controller 250 at shorter intervals such as every half second (e.g., using the 500 msec sample window). According to some example embodiments, the tag 110 may be configured to send a motion start message to the system controller 250 to inform the system controller 250 that the tag has locally detected motion and that the tag will now be communicating at shorter intervals. The system controller 250 may track movement of the tag 110 after the motion start message is received and either update the position of the tag 110 (e.g., on a display or in a database or position log) or perform some other function based on the position of the tag 110 (e.g., inform staff of the tag location, generate an alarm or notification, etc.). When the tag 110 stops moving for a predetermined period of time (e.g., a local timer may be employed that resets in response to actuation of the jiggle switch or the like), a motion end message may be sent to the system controller 250 and, in some cases, the tag 110 may shift back to a low power mode.

As shown in FIG. 2, a plurality of the RSSI locators 212 may be positioned in corresponding zones that are to be monitored using RSSI. For example, the RSSI locators 212 may be positioned at corners or boundaries of the zones. In some example embodiments, the RSSI locators 212 could also be located within zones and the boundaries of the zones may be defined based on a predefined distance from one or more of the RSSI locators 212. The tags 110 may receive transmissions from the RSSI locators 212 and communicate information indicative of a location determined based on signal strength or signal strength data to be used to determine location through a router 240 to a system controller 250. The system controller 250 may, for example, be a computer, server or other terminal that may host software and/or hardware configurable to transform the data indicative of physical location of the tags 110 and the objects to which they are attached into trackable items that may be used to trigger various theft deterrent functions as described herein.

In some example embodiments, the system controller 250 may also be in communication with the AOA locators 222. The AOA locators 222 may be disposed within or around boundaries of the zone monitored via the second locating system 220 in a similar manner to the disposal of the RSSI locators 212 described above, or in a number of other configurations. However, the AOA locators 222 may listen for beacon signals instead of transmitting any beaconing signals. Thus, when the tags 110 are transmitting beacon signals for operation to the second locating system 220, the AOA locators 222 may each determine angle information indicative of the angle of the tag 110 relative to the corresponding AOA locator 222, or more specifically, the antennas of the AO locator 222 (or provide such information to the system controller 250 as is needed to enable the system controller 250 to determine the angle information). An estimated tag location may then be determined (e.g., via analysis of the angle information or via triangulation) by the system controller 250.

Figure 3:
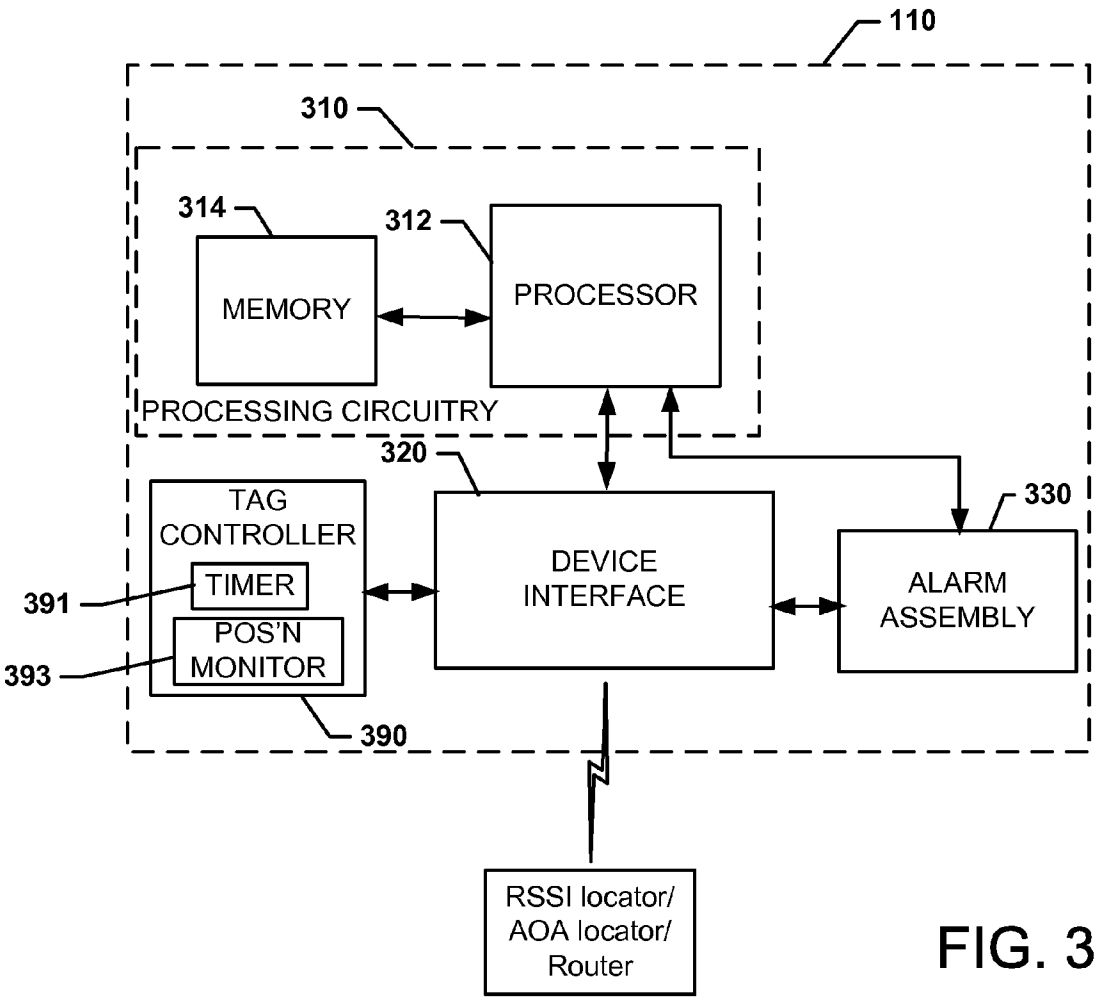
FIG. 3 illustrates a block diagram of a tag according to an example embodiment.

FIG. 3 illustrates a block diagram of tag circuitry in accordance with an example embodiment. As shown in FIG. 3, the tag 110 may include processing circuitry 310 configured in accordance with an example embodiment as described herein. In this regard, for example, the tag 110 may utilize the processing circuitry 310 to provide electronic control inputs to one or more functional units (which may be implemented by or with the assistance of the of the processing circuitry 310) of the tag 110 to receive, transmit and/or process data associated with the one or more functional units and perform communications necessary to enable tracking of tags, issuing of alarms and/or alerts and/or the like as described herein.

In some embodiments, the processing circuitry 310 may be embodied as a chip or chip set. In other words, the processing circuitry 310 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 310 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 310 may include one or more instances of a processor 312 and memory 314 that may be in communication with or otherwise control a device interface 320. As such, the processing circuitry 310 may be embodied as a circuit chip (e.g., an integrated circuit chip) configured (e.g., with hardware, software or a combination of hardware and software) to perform operations described herein.

The device interface 320 may include one or more interface mechanisms for enabling communication with other devices (e.g., RSSI locators 212, AOA locators 222, routers 240, other tags 110, tag readers, and/or other devices). In some cases, the device interface 320 may be any means such as a device or circuitry embodied in either hardware, or a combination of hardware and software that is configured to receive and/or transmit data from/to devices or components in communication with the processing circuitry 310 via internal and/or external communication mechanisms. Accordingly, for example, the device interface 320 may further include wireless communication equipment (e.g., one or more antennas) for at least communicating with RSSI locators 212, AOA locators 222, and/or routers 240. The device interface 320 may therefore include one or more antenna arrays that may be configured or configurable to receive and/or transmit properly formatted signals associated with at least the first locating system 210 and the second locating system 220. The device interface 320 may further include radio circuitry configured to encode and/or decode, modulate and/or demodulate, or otherwise process wireless signals received by or to be transmitted by the antenna array(s).

In some embodiments, the tag 110 may also include an alarm assembly 330, which may include an audio device (e.g., a piezoelectric, mechanical, or electromechanical beeper, buzzer or other audio signaling device such as an audible alarm). The alarm assembly 330 may include a speaker or other sound generating device that may be provided in a housing of the tag 110. In some example embodiments, the alarm assembly 330 may also include visible indicia (e.g., lights of one or more colors such as a bi-color (e.g., red/green) LED). The visible indicia of the alarm assembly 330 and/or the audio device thereof may be used in various ways to facilitate or enhance operation of the tag 110. For example, different tones, sounds, or music may be played when the tag 110 receives different messages, or is operated in a certain way (e.g., movement into or out of a particular zone, proximity to a gate, passage through the gate, loss of communication with the network, detection of tampering or cutting of wires that affixed the tag 110 to an object, etc.). Similarly, different light colors, light flash sequences or other visible indicia may be provided in combination with or instead of the audible indicia in order to indicate certain conditions (e.g., movement into or out of a particular zone, proximity to a gate, passage through the gate, loss of communication with the network, detection of tampering or cutting of wires that affixed the tag 110 to an object, etc.).

The processor 312 may be embodied in a number of different ways. For example, the processor 312 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 312 may be configured to execute instructions stored in the memory 314 or otherwise accessible to the processor 312. As such, whether configured by hardware or by a combination of hardware and software, the processor 312 may represent a physical entity (e.g., physically embodied in circuitry—in the form of processing circuitry 310) capable of performing operations according to example embodiments while configured accordingly. Thus, for example, when the processor 312 is embodied as an ASIC, FPGA or the like, the processor 312 may be specifically configured hardware for conducting the operations described herein. Alternatively, as another example, when the processor 312 is embodied as an executor of software instructions, the instructions may specifically configure the processor 312 to perform the operations described herein in reference to execution of an example embodiment.

In some examples, the processor 312 (or the processing circuitry 310) may be embodied as, include or otherwise control the operation of the tag 110 based on inputs received by the processing circuitry 310. As such, in some embodiments, the processor 312 (or the processing circuitry 310) may be said to cause each of the operations described in connection with the tag 110 to occur in relation to operation of the tag 110 relative to undertaking the corresponding functionalities associated therewith responsive to execution of instructions or algorithms configuring the processor 312 (or processing circuitry 310) accordingly. In particular, the processor 312 (or processing circuitry 310) may be configured to enable the tag 110 to communicate with the RSSI locators 212, AOA locators 222, and/or routers 240 to provide information to the system controller 250 that enables the system controller 250 to locate the tag and, in some cases, perform other functions based on the location of the tag 110 or other information about the status of the tag 110 that is determinable from the communications with the tag 110 (or lack thereof).

In an example embodiment, the memory 314 may include one or more non-transitory memory devices such as, for example, volatile and/or non-volatile memory that may be either fixed or removable. The memory 314 may be configured to store information, data, applications, instructions or the like for enabling the processing circuitry 310 to carry out various functions in accordance with example embodiments. For example, the memory 314 may be configured to buffer input data for processing by the processor 312. Additionally or alternatively, the memory 314 may be configured to store instructions for execution by the processor 312. As yet another alternative or additional capability, the memory 314 may include one or more databases that may store a variety of data sets or tables useful for operation of the tag 110. Among the contents of the memory 314, applications or instruction sets may be stored for execution by the processor 312 in order to carry out the functionality associated with each respective application or instruction set. In some cases, the applications/instruction sets may include instructions for carrying out some or all of the operations described in reference to the algorithms or flow charts described herein. In particular, the memory 314 may store executable instructions that enable the computational power of the processing circuitry 310 to be employed to improve the functioning of the tag 110 relative to the tracking, notifying and alarming functions described herein. As such, the improved operation of the computational components of the tag 110 transforms the tag 110 into a more capable tracking, notifying and alarming device relative to the physical objects to which the tag 110 is attached. Thus, for example, the tag 110 may be transformed into a device that can report its location so that movement of the tag 110 is capable of being analyzed to support various enhanced or additional functions associated with improving customer service by enhancing staff attentiveness to customers in need of assistance.

In connection with accomplishing the improved functionality of the tag 110, the tag 110 may be configurable to shift between operation in the first locating system 210 and the second locating system 220. However, such mode shifting is not necessary in all cases. When employed, however, the tag 110 may be configured to operate in one of the first locating system 210 and the second locating system 220 based on time and/or location responsive to initial movement of the tag 110. Thus, as mentioned above, the tag 110 may be in a sleep mode until awoken by movement. After sending a motion start message, the tag 110 may begin communication in one of the first locating system 210 and the second locating system 220 based, for example, on the location of the tag 110 when the motion start message is sent or based on the time that the motion start message is sent. The tag 110 may switch between the first locating system 210 and the second locating system 220 thereafter as directed.

As the tag 110 communicates with the first locating system 210 and/or the second locating system 220, the position or location of the tag may be determined by a tag controller 390 that may be distributed between the tag 110 and the system controller 250, or that may be located at the system controller 250. The tag controller 390 may be configured to monitor movement of the tag 110 relative to alerting criteria and issue alerts when appropriate.

Figure 4:
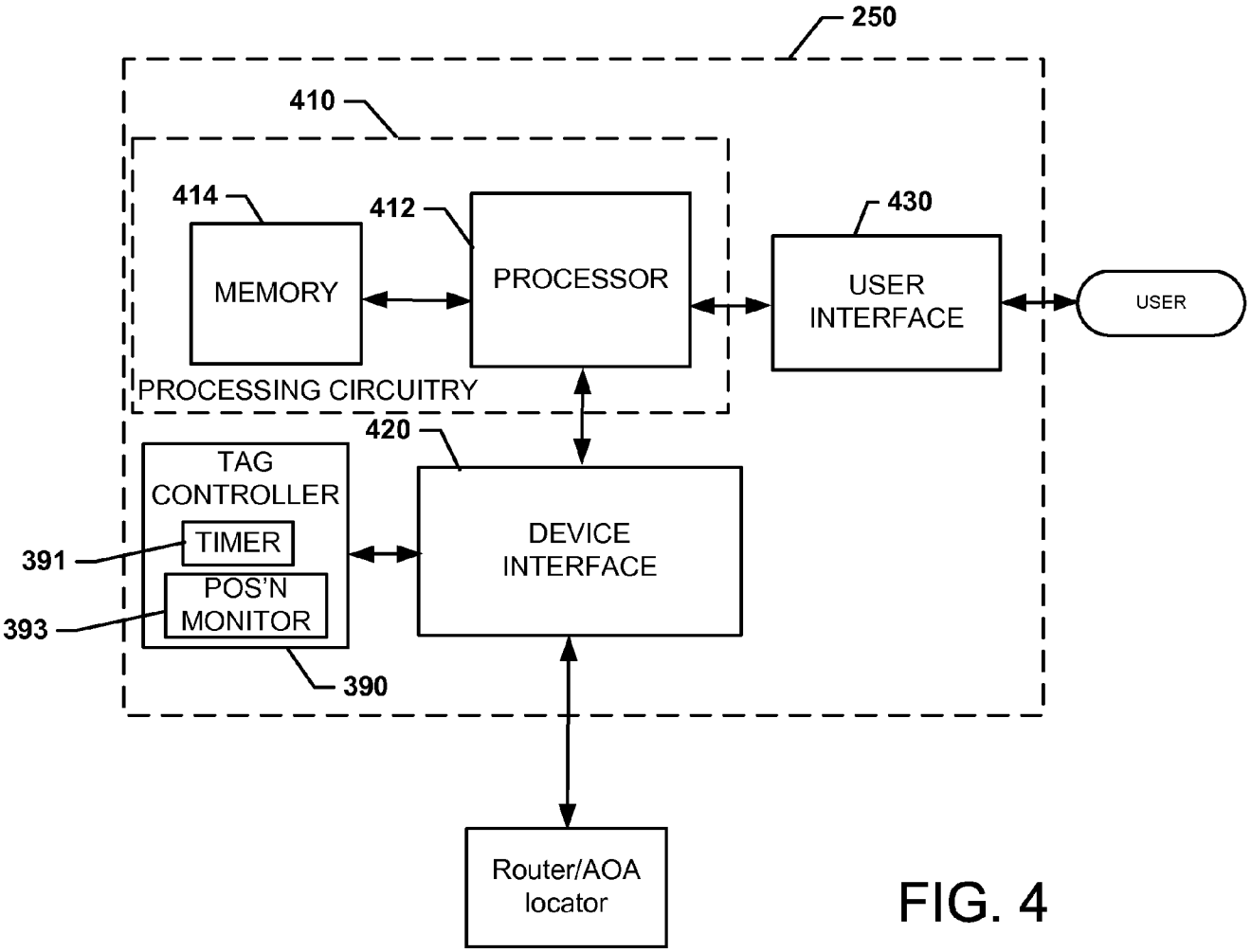
FIG. 4 illustrates a block diagram of a system controller according to an example embodiment.

FIG. 4 illustrates a block diagram of the system controller 250 in accordance with an example embodiment. As shown in FIG. 4, the system controller 250 may include processing circuitry 410 of an example embodiment as described herein. In this regard, for example, the system controller 250 may utilize the processing circuitry 410 to provide electronic control inputs to one or more functional units of the system controller 250 to obtain, transmit and/or process data associated with the one or more functional units and perform the subsequent locating, tracking, notification, and/or alarm functions described herein. The system controller 250 may also initiate and control alerting functions in some cases, as described below.

In some embodiments, the processing circuitry 410 may be embodied in physical and functional form in a similar manner to that which has been described above with respect to FIG. 3. However, according to some example embodiments, the processing circuitry 410 may have expanded capabilities with respect to processing speed and communication throughput relative to the processing circuitry utilized by the tag 110.

In an example embodiment, the processing circuitry 410 may include one or more instances of a processor 412 and memory 414 that may be in communication with or otherwise control a device interface 420 and, in some cases, a user interface 430. As such, the processing circuitry 410 may be embodied as a circuit chip (e.g., an integrated circuit chip) configured (e.g., with hardware, software or a combination of hardware and software) to perform operations described herein.

The user interface 430 may be in communication with the processing circuitry 410 to receive an indication of a user input at the user interface 430 and/or to provide an audible, visual, tactile or other output to the user. As such, the user interface 430 may include, for example, a touch screen, one or more switches, buttons or keys (e.g., function buttons), mouse, joystick, keyboard, and/or other input mechanisms. In an example embodiment, the user interface 430 may include one or a plurality of lights, a display, a speaker, a tone generator, a vibration unit and/or the like as potential output mechanisms.

The device interface 420 may include one or more interface mechanisms for enabling communication with other devices (e.g., AOA locators 222, routers 240 and/or external network devices). In some cases, the device interface 420 may be any means such as a device or circuitry embodied in either hardware, or a combination of hardware and software that is configured to receive and/or transmit data from/to devices or components in communication with the processing circuitry 410 via internal and/or external communication mechanisms. Accordingly, for example, the device interface 420 may further include Ethernet connections and/or wireless communication equipment for at least communicating with the AOA locators 222 and/or routers 240.

The processor 412 may be embodied in a number of different ways. For example, the processor 412 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 412 may be configured to execute instructions stored in the memory 414 or otherwise accessible to the processor 412. As such, whether configured by hardware or by a combination of hardware and software, the processor 412 may represent an entity (e.g., physically embodied in circuitry—in the form of processing circuitry 410) capable of performing operations according to embodiments of the present invention while configured accordingly. Thus, for example, when the processor 412 is embodied as an ASIC, FPGA or the like, the processor 412 may be specifically configured hardware for conducting the operations described herein. Alternatively, as another example, when the processor 412 is embodied as an executor of software instructions, the instructions may specifically configure the processor 412 to perform the operations described herein in reference to execution of an example embodiment.

In some examples, the processor 412 (or the processing circuitry 410) may be embodied as, include or otherwise control the operation of the system controller 250 based on inputs received by the processing circuitry 410. As such, in some embodiments, the processor 412 (or the processing circuitry 410) may be said to cause each of the operations described in connection with the system controller 250 in relation to operation of the system controller 250 relative to undertaking the corresponding functionalities associated therewith responsive to execution of instructions or algorithms configuring the processor 412 (or processing circuitry 410) accordingly. In particular, the processor 412 (or processing circuitry 410) may be configured to enable the system controller 250 to communicate with the AOA locators 222, and/or routers 240 to provide information to the system controller 250 that enables the system controller 250 to locate the tag 110 and, in some cases, perform other functions based on the location of the tag 110 or other information about the status of the tag 110 that is determinable from the communications with the tag 110 (or lack thereof).

In an exemplary embodiment, the memory 414 may include one or more non-transitory memory devices such as, for example, volatile and/or non-volatile memory that may be either fixed or removable. The memory 414 may be configured to store information, data, applications, instructions or the like for enabling the processing circuitry 410 to carry out various functions in accordance with exemplary embodiments of the present invention. For example, the memory 414 could be configured to buffer input data for processing by the processor 412. Additionally or alternatively, the memory 414 could be configured to store instructions for execution by the processor 412. As yet another alternative or additional capability, the memory 414 may include one or more databases that may store a variety of data sets or tables useful for operation of the system controller 250. Among the contents of the memory 414, applications or instruction sets may be stored for execution by the processor 412 in order to carry out the functionality associated with each respective application or instruction set. In some cases, the applications/instruction sets may include instructions for carrying out some or all of the operations described in reference to the algorithms or flow charts described herein. In particular, the memory 414 may store executable instructions that enable the computational power of the processing circuitry 410 to be employed to improve the functioning of the system controller 250 relative to the tracking, notifying and alarming functions described herein. As such, the improved operation of the computational components of the system controller 250 transforms the system controller 250 into a more capable tracking, notifying and alarming device relative to the physical objects to which the tag 110 is attached. The processing circuitry 410 may therefore be configured, e.g., by instruction execution, to receive signals from the tags (e.g., via the locators and/or the router 240) and transform attributes of the received signals into data describing the location of the tags 110 for presentation to a user on a terminal or to trigger other functionalities of the system. The processing circuitry 410 may also transform information indicative of the location of the tag 110 and/or time into functional inputs that can be compared to predefined criteria to cause alerting functions to be executed as described herein when the functional inputs match the predefined criteria. When operating in this capacity, an instance of the tag controller 390 may be provided at the system controller 250 alone, as an alternative to embodying the tag controller 390 at the tag 110, or as a distributed component that may integrate and operate in cooperation with a corresponding distributed component at the tag 110.

The tag controller 390 may therefore be any means or device embodied in hardware, software or a combination of hardware and software that may be configured to direct operation of the tag 110 at least with respect to the position monitoring, behavior classification or characterization based on position monitoring, and alerting operations described herein. The tag controller 390 may therefore be controlled by the processing circuitry 310 or even may be embodied by the processing circuitry 310. In any case, the processing circuitry 310 may be said to cause the operations of the tag controller 390 at least with respect to portions of the tag controller 390 that are embodied at the system controller 250 (and sometimes also portions embodied at the tag 110).

In an example embodiment, the tag controller 390 may be configured to provide instructions for handling information locally or for directing operation of the tags for location reporting, behavior classification, alerting and/or the like. In some cases, the tag controller 390 may be configured to communicate with tags or receive information from locators or other components where such information is indicative of the movement of the tags. As described above, in some cases, the tags may send messages once they are awoken from a sleep state by movement and tracking of the tags may occur responsive to the sending of these messages. Based on the tracking of the tags, the tag controller 390 may be configured to determine whether alerting criteria are met. In this regard, for example, the tag controller 390 may reference a table, or other stored repository of tag movement profiles that require an alert to be issued to store personnel. In some cases, the alerting criteria may include at least a position component and a temporal component. The position component may define location based rules or criteria relative to proximity to a reference point, or position within a particular zone. The temporal component may define a period of time during which the position component must be met or true. When both the position component and the temporal component are met or true, then the alerting criteria may be considered to be met and a corresponding alert may be issued relative to the product and/or location of the product to which the tag 110 is attached.

Accordingly, for example, the location of the tag 110, and particularly the movement of the tag 110, may be monitored relative to the amount of time during which the tag 110 remains in continuous (or nearly continuous) motion within a particular area. If the tag 110 is moving within a particular department for at least a given time, the chances may be relatively high that the customer is looking for something or someone that the customer, for whatever reason, is having difficulty locating. This may represent an optimal time for store personnel to move to the location of the customer to offer assistance. If the customer is indeed looking for something or someone, the store personnel may actually be able to preempt any frustration the customer may encounter by offering assistance. Moreover, the customer may actually be looking for the store personnel, and thus, the customer's desires may, in any case, be satisfied.

In practice, the movement of the tag 110 may be monitored relative to position and time criteria that may define the profile of a customer that likely needs assistance. The position criteria (or position component) may be arbitrarily defined or may correlate to specific departments or zones within the store. Furthermore, in some cases, a zone may correlate to the entire sales floor of the store. In some cases, the position component could be defined by a distance from a reference location (e.g., the location at which the product on which the tag 110 is affixed was picked up). Meanwhile, the temporal component may simply define a period of time during which the tag 110 is in motion either continuously or nearly continuously. As such, motion may be considered to be continuous (or nearly continuous) when such motion does not stop for a period greater than a threshold amount (e.g., 2 seconds, 5 seconds, etc.). As such, in an example embodiment, the alerting criteria may be defined in terms of comparing location and time criteria to corresponding location and time information measured based on the tracking of the tag 110. In some cases, average motion vectors indicative of tag 110 movement may be employed relative to practicing example embodiments. As such, for example, the tag controller 390 may be configured to receive information indicative of, or otherwise determine itself, average motion vectors for each tag. The average motion vectors may then be compared to a movement profile defining alerting criteria as described herein.

In some cases, the position component and/or the temporal component may be fixed values. However, in other cases, either of both of such components may be variable either in real time or by operator entry of such criteria by programming the tag controller 390 to modify the settings of such components. In cases where the operator sets the values of such components, companies may issue guidelines based on customer feedback or surveys that may seek to identify how long it takes for a customer to be frustrated when searching for a product or assistance. Statistical data from other stores in the industry or in a particular chain may also be used for setting such components. The operator may also alter such components for specific products, at specific times of the year, for certain departments or sales events, or any other desirable criteria.

In examples in which the components (temporal and/or position) are variable in real time (or near real time), the components (either or both) may be modified automatically based on various criteria. For example, in some cases, the temporal or position components may be automatically adjusted based at least in part on a characteristic of the product to which the tag 110 is attached. As such, again for example, the tag 110 may be attachable to various products. However, the tag 110 may be programmed with information identifying the product to which it is attached. Each product may have a corresponding temporal and/or position component predefined (e.g., in a table) and the components may automatically be updated as soon as the product is identified. In some examples, the distance or period of time may be variable (in a fixed or variable sense) in inverse proportion to the product cost. However, other product type-based criteria may also be employed.

In some other examples, the temporal component or position component may automatically change or be updated based on various events or activities. For example, the time component may have a particular value in some zones, but the particular value may increase (or decrease) responsive to movement of the tag 110 to another zone. Similarly, if the temporal component reaches certain levels, the position component may be modified accordingly without necessarily triggering an alerting function. For example, continuous movement for 10 minutes within the store may trigger an alerting function (i.e., by the alerting criteria being met). However, continuous movement for 5 minutes may trigger the position component to be narrowed so that continuous movement is monitored relative to a more discrete location (e.g., a smaller zone or department). Such modification may distinguish between a parent that is, for example, pushing a sleeping baby throughout the store to pass time while a companion is shopping, and a person who is actually looking for assistance within a particular department.

As can be appreciated from the descriptions above, the movement of the tag 110 in a particular area may be of interest relative to determining whether assistance is needed. Thus, mere monitoring of the position of the tag 110 (e.g., perhaps while resting) may not be of interest in some (but not all) cases. Instead, it may sometimes be desirable to determine how long a customer wanders or moves within a particular area. As such, the period of time that a tag remains in a zone or area may, in some cases, only be measured when the tag is in motion (continuously or nearly continuously). As such, the tag controller 390 may include a timer 391 configured to count time (up or down) to one or more predefined time thresholds or periods of time. The timer 391 may be configured to start responsive to a motion start message and stop or be reset responsive to receipt of a motion end message, or if the tag 110 goes to sleep. In some cases, the tag controller 393 may include a position monitor 393 configured to monitor movement of the tag 110 to ensure that the tag 110 stays in motion (continuously or nearly continuously) to enable the timer 391 to run. If motion stops for at least a given amount of time, the timer 391 may be reset. If motion takes the tag 110 out of a particular zone, the timer 391 may be reset. Other reset events may also be defined.

As indicated above, when the alerting criteria are met (e.g., criteria defining the amount of time that the tag is to remain in motion within an area or zone in order to trigger alerting), an alerting function may be triggered. The alerting function may include providing direction for assistance to be provided in a zone associated with the location information. In this regard, an audible notification stating, for example, that a customer needs assistance in the area or zone in which the alerting function was triggered may be provided over a communication network (e.g., headset or amplified circuit). Alternatively or additionally, an email or text notification via a handheld device, or a message, alarm or notification via a display associated with the system controller 250 may be provided indicating the location and nature of the alert.

As can be appreciated from the preceding descriptions, notifications and/or alerts to be generated by the system may be programmed for generation based on various criteria to ensure that customer assistance can be provided in a reasonably short amount of time. In an example embodiment, the system controller 250 and/or tag controller 390 may therefore be configured to receive information indicative of tag location and/or movement and make decisions on issuing alerts or notifications as described above. When the tag controller 390 is embodied at the system controller 250, the tag controller 390 may direct the tags to execute certain instructions stored at the tags, or may instruct the tags for specifically defined behaviors. When the tag controller 390 is split between tags and system controller 250, the tag controller 390 instances may communicate cooperatively to execute example embodiments. When the tag controller 390 is implemented at the system controller 250, the tag controller 390 may receive information from the tags and/or the locators and may process the information remotely and act accordingly based on the information.

Figure 5:
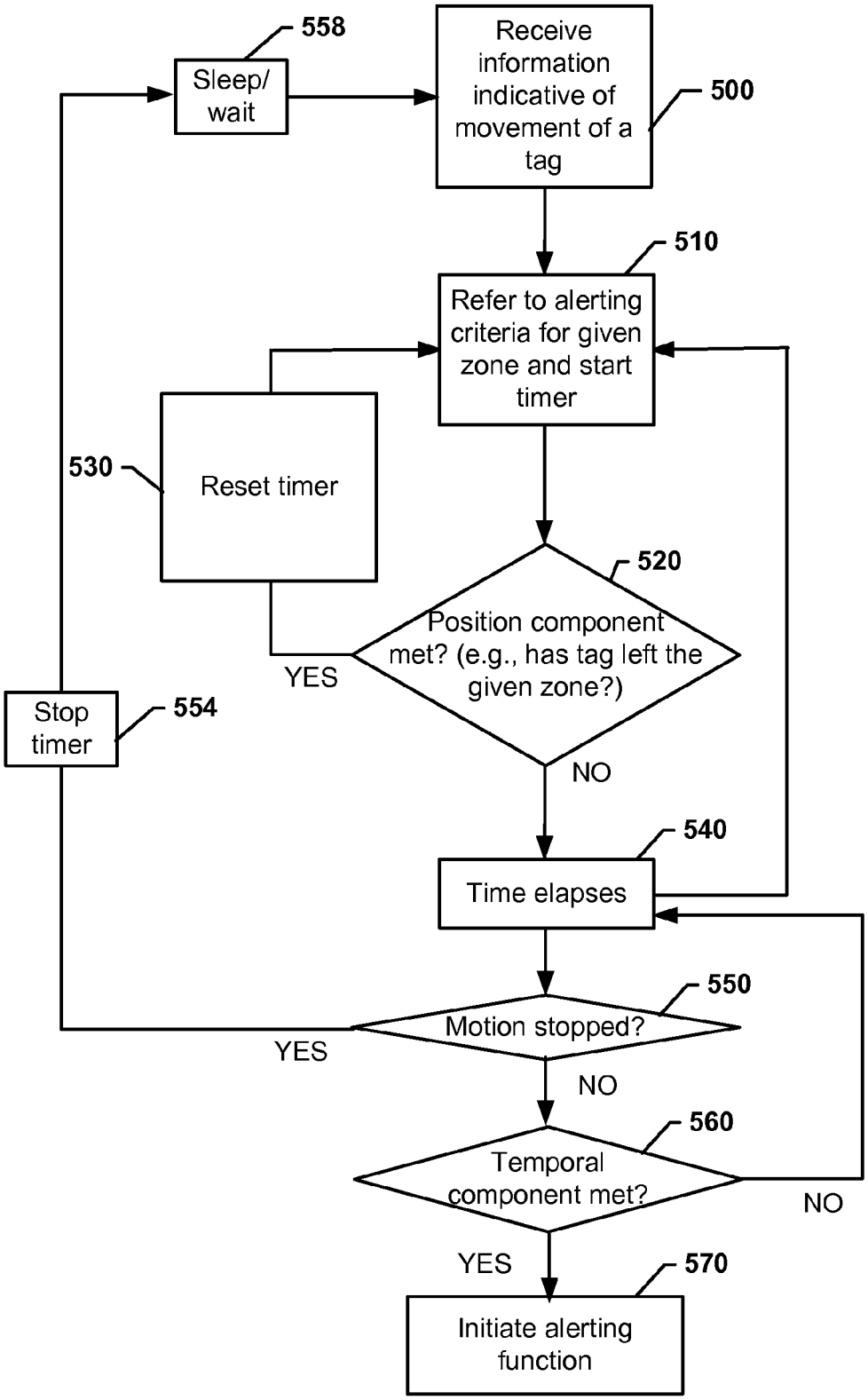
FIG. 5 illustrates a block diagram showing a control flow representative of an algorithm executable at a tag controller in accordance with an example embodiment.
Figure 6:
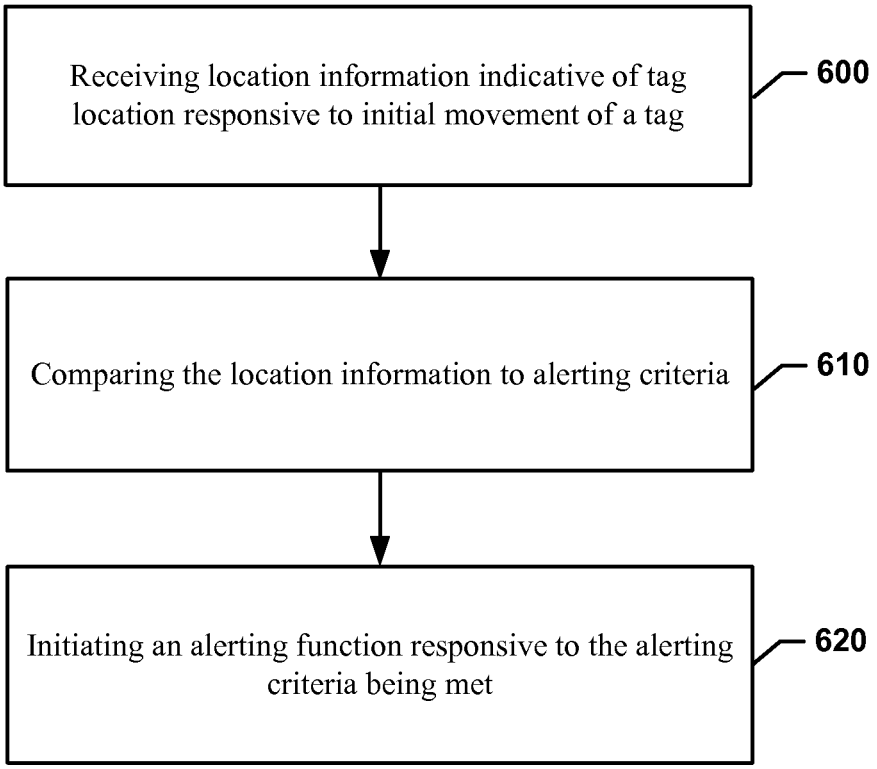
FIG. 6 illustrates a block diagram of a method of determining when a tag in a monitoring system should be grouped in accordance with an example embodiment.

From a technical perspective, the tag controller 390 embodied at either or both of the system controller 250 and the tag 110 described above may be used to support some or all of the operations described above. As such, the platforms described in FIGS. 1-4 may be used to facilitate the implementation of several computer program and/or network communication based interactions. As an example, FIGS. 5 and 6 are flowcharts of example methods and program products according to an example embodiment. It will be understood that each block of the flowcharts, and combinations of blocks in the flowcharts, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of a computing device and executed by a processor in the computing device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, FIG. 5 illustrates a block diagram showing a control flow representative of an algorithm executable at the tag controller 390 (e.g., at the system controller 250 and/or tag 110) in accordance with an example embodiment. As shown in FIG. 5, the tag controller 390 may initially receive information indicative of movement of a tag at operation 500. As discussed above, the information may be routine tacking information associated with one of the locating systems. The tag controller 390 may refer to the alerting criteria for the location of the tag (e.g., in case different criteria are associated with different locations) at operation 510. The tag controller 390 may also start a timer. A determination may then be made at operation 520 as to whether the position component is met based on the current tag location and/or movement. As an example, a determination may be made to see if the tag has left the given zone. If there has been a zone change or the position component is otherwise met, then the timer is reset at operation 530 and operation 510 is repeated for the new location or zone. However, if the tag movements indicate that the position component is not met, then time continues to elapse (or count in some way) at operation 540. A determination may then be made to see if motion has stopped at operation 550. If motion has stopped, the timer may be stopped at operation 554 and flow may return to operation 500 if the tag is awoken from a sleep or wait state at operation 558. However, if motion has not stopped then a determination may be made as to whether the temporal component is met at operation 560. If the temporal condition has not been met (e.g., if the timer has not expired for movement in the given zone), then the timer may continue to elapse at operation 540. However, if the temporal condition has been met, then initiation of the alerting function may be conducted at operation 570.

FIG. 6 illustrates a block diagram of a method of controlling intelligent tracking or otherwise monitoring of a security device (e.g., a security tag) in accordance with an example embodiment. The security devices or tags may each be associated with corresponding products (e.g., retail items) in a monitoring environment. The method may be executed by a tag controller that may be configured to interface with the security tags. The tag controller may include processing circuitry configured to perform the method of FIG. 6. The method may include receiving location information indicative of tag location responsive to initial movement of a tag at operation 600. The method may further include comparing the location information to alerting criteria at operation 610. The alerting criteria may include at least a position component and a temporal component. The method may further include initiating an alerting function responsive to the alerting criteria being met at operation 620.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the position component may define an area inside which the tag has remained for a period of time defined by the temporal component. In some embodiments, the position component may define a reference location and a distance from the reference location within which the tag has remained for a period of time defined by the temporal component. In some cases, at least one of the distance or the period of time is variable based at least in part on a characteristic of the product. In some examples, the distance or period of time may decrease as product cost increases. In an example embodiment, the period of time may be measured only when the tag is in motion. In some cases, the position component may be defined in relation to a plurality of zones. In such an example, the period of time may be variable based at least in part on which of the zones the tag is located within. In some embodiments, initiating the alerting function may include providing direction for assistance to be provided in a zone associated with the location information. In an example embodiment, the position component may be defined in relation to a plurality of zones. In such an example, motion of the tag outside of one of the zones resets the temporal component. In some cases, in response to a lack of motion for at least a given amount of time, the temporal component may be reset.

The alerting functions described herein may be useful in improving customer service, and by improving the perception customers have of the service level and attentiveness of staff. Example embodiments may also enhance security in direct and indirect ways. Effectiveness and overall cost to a retailer using instances of the security device to protect products may therefore be reduced.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tag controller configured to interface with one or more security tags, at least one of which is adapted to be disposed on a product in a monitoring environment, the tag controller comprising processing circuitry configured to:

receive location information indicative of tag location responsive to movement of a tag;

compare the location information to alerting criteria, the alerting criteria including at least a position component defining an area and a temporal component defining a period of time; and initiate an alerting function responsive to the alerting criteria being met, wherein the alerting criteria are met in response to the tag being located in the area for the period of time, wherein the period of time is measured only when the tag is in motion.

2. The tag controller of claim 1, wherein the area is defined by a reference location and a distance from the reference location.

3. The tag controller of claim 2, wherein at least one of the distance or the period of time is variable based at least in part on a characteristic of the product.

4. The tag controller of claim 3, wherein the distance decreases as product cost increases.

5. The tag controller of claim 3, wherein the period of time decreases as product cost increases.

6. A tag controller configured to interface with one or more security tags, at least one of which is adapted to be disposed on a product in a monitoring environment, the tag controller comprising processing circuitry configured to:

receive location information indicative of tag location responsive to movement of a tag;

compare the location information to alerting criteria, the alerting criteria including at least a position component defining an area and a temporal component defining a period of time; and initiate an alerting function responsive to the alerting criteria being met, wherein the alerting criteria are met in response to the tag being located in the area for the period of time, and wherein the position component is defined in relation to a plurality of zones, and wherein the period of time is variable based at least in part on which of the zones the tag is located within.

7. The tag controller of claim 1, wherein initiating the alerting function comprises providing direction for assistance to be provided in a zone associated with the location information.

8. The tag controller of claim 1, wherein the position component is defined in relation to a plurality of zones, and wherein motion of the tag between zones resets the temporal component.

9. The tag controller of claim 1, wherein, in response to a lack of motion for at least a given amount of time, the temporal component is reset.

10. A security system comprising:

a plurality of security tags disposed on a corresponding plurality of products in a monitoring environment;

a plurality of locator devices associated with a locating system for tracking the security tags in the monitoring environment; and a tag controller comprising processing circuitry configured to:

receive location information indicative of tag location responsive to movement of a tag;

compare the location information to alerting criteria, the alerting criteria including at least a position component defining an area and a temporal component defining a period of time; and initiate an alerting function responsive to the alerting criteria being met, wherein the alerting criteria are met in response to the tag being located in the area for the period of time, and wherein the period of time is measured only when the tag is in motion.

11. The security system of claim 10, wherein the area is defined by a reference location and a distance from the reference location.

12. The security system of claim 11, wherein at least one of the distance or the period of time is variable based at least in part on a characteristic of the product.

13. The security system of claim 12, wherein the distance decreases as product cost increases.

14. The security system of claim 12, wherein the period of time decreases as product cost increases.

15. The security system of claim 11, wherein the position component is defined in relation to a plurality of zones, and wherein the period of time is variable based at least in part on which of the zones the tag is located within.

16. The security system of claim 10, wherein initiating the alerting function comprises providing direction for assistance to be provided in a zone associated with the location information.

17. The security system of claim 10, wherein the position component is defined in relation to a plurality of zones, and wherein motion of the tag between zones resets the temporal component.

18. The security system of claim 10, wherein, in response to a lack of motion for at least a given amount of time, the temporal component is reset.

* * * * *